US007234961B2

(12) United States Patent
Arlitt et al.

(10) Patent No.: US 7,234,961 B2
(45) Date of Patent: Jun. 26, 2007

(54) CONNECTOR ARRANGEMENT INCLUDING INSULATED CONDUCTOR TAP-OFF MEANS

(75) Inventors: Uwe Arlitt, Leopoldshöhe (DE); Paulo Russo, Lage (DE); Rainer Schulze, Detmold (DE); John Witt, Detmold (DE); Günter Lucht, Horn-Bad Meinberg (DE); Joachim Bury, Detmold (DE); Torsten Diekmann, Leopoldshöhe (DE); Andreas Wedler, Detmold (DE); Thomas Salomon, Gütersloh (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/518,771

(22) Filed: Sep. 11, 2006

(65) Prior Publication Data

US 2007/0066123 A1 Mar. 22, 2007

(30) Foreign Application Priority Data

Sep. 17, 2005 (DE) ..... 20 2005 014 719 U

(51) Int. Cl.
*H01R 11/20* (2006.01)

(52) U.S. Cl. ..... 439/410; 439/709; 439/716; 439/212; 439/397

(58) Field of Classification Search ..... 439/397–400, 439/406, 409–410, 709–711, 716–717, 212–213
See application file for complete search history.

(56) References Cited

U.S. PATENT DOCUMENTS

| | | | | |
|---|---|---|---|---|
| 5,651,702 | A * | 7/1997 | Hanning et al. | 439/715 |
| 5,762,518 | A * | 6/1998 | Tanigawa et al. | 439/409 |
| 6,120,315 | A * | 9/2000 | Gaertner et al. | 439/395 |
| 6,135,804 | A * | 10/2000 | Lux | 439/397 |
| 6,213,809 | B1 * | 4/2001 | Viklund | 439/418 |
| 6,238,233 | B1 | 5/2001 | Drexler et al. | |
| 6,261,120 | B1 | 7/2001 | Beege et al. | |
| 6,280,233 | B1 | 8/2001 | Beege et al. | |
| 6,478,605 | B2 | 11/2002 | Stuckmann et al. | |
| 6,692,292 | B2 * | 2/2004 | Huiskamp et al. | 439/417 |
| 6,712,641 | B2 | 3/2004 | Beege et al. | |
| 6,796,855 | B2 | 9/2004 | Fricke et al. | |

(Continued)

FOREIGN PATENT DOCUMENTS

DE 34 06 739 A1 9/1884

(Continued)

*Primary Examiner*—Truc Nguyen
(74) *Attorney, Agent, or Firm*—Lawrence E. Laubscher, Sr.; Lawrence E. Laubscher, Jr.

(57) ABSTRACT

An electrical connector arrangement taps off electrical current from a plurality of coplanar parallel input insulated conductors and supplies the same to a plurality of output conductors, respectively. A rectangular base member is provided having a horizontal upper surface that supports a plurality of parallel coplanar longitudinally-extending input conductors, respectively. A pair of pivot members are connected with the ends of the base member for pivotal movement about transverse horizontal pivot axes, respectively. As the pivot members are pivoted from disengaged positions toward engaged positions parallel with and directly above the base member top surface, bifurcated insulation-piercing knives on the pivot members pierce the insulation layers of the insulated conductors and electrically engage the conductors. Junction blocks fastened to the pivot members include output contacts connected with the insulation piercing knives via bus bars, which output contacts are connected with the output conductors, respectively.

17 Claims, 14 Drawing Sheets

U.S. PATENT DOCUMENTS

| | | | | |
|---|---|---|---|---|
| 6,893,286 | B2 | 5/2005 | Drewes et al. | |
| 7,192,316 | B1 * | 3/2007 | Pollmann | 439/716 |

FOREIGN PATENT DOCUMENTS

| | | | |
|---|---|---|---|
| DE | 297 06 750 | U1 | 7/1997 |
| DE | 101 50 044 | A1 | 5/2003 |
| DE | 102 01 495 | A1 | 8/2003 |
| EP | 02 74 948 | A1 | 7/1988 |
| WO | WO 97/34 338 | A1 | 9/1997 |
| WO | WO 99/04 455 | A1 | 1/1999 |

* cited by examiner

CONNECTOR ARRANGEMENT INCLUDING INSULATED CONDUCTOR TAP-OFF MEANS

BACKGROUND OF THE INVENTION

1. Field of the Invention

An electrical connector arrangement for tapping off electrical current from a plurality of coplanar parallel input insulated conductors and supplying the same to a plurality of output conductors, respectively, includes a rectangular base member having a horizontal upper surface that supports a plurality of parallel coplanar longitudinally-extending alternately-staggered input conductors, respectively, and a pair of pivot members connected with the ends of the base member for pivotal movement about transverse horizontal pivot axes, respectively. As the pivot members are pivoted from disengaged positions relative to the base member toward engaged positions parallel with and directly above the base member top surface, bifurcated insulation-piercing knives on the pivot members pierce the insulation layers of the insulated conductors and electrically engage the conductors. Junction blocks fastened to the pivot members include output contacts connected with the insulation piercing knives via bus bars, which output contacts in turn are connected with the output conductors, respectively.

2. Description of Related Art

It is well known in the patented prior art to provide connectors with insulation piercing contacts, as shown, for example, by the prior U.S. patents to Gaertner et al U.S. Pat. No. 6,120,315, Lux U.S. Pat. No. 6,135,804, Stuckmann et al U.S. Pat. No. 6,478,605, and Huiskamp et al U.S. Pat. No. 6,692,292, among others. It is also known to provide quick-fastening terminal blocks and junction blocks having one-way resilient contacts for automatically engaging and retaining a bare conductor end that is inserted through an access opening, as shown by the patents to Beege et al U.S. Pat. Nos. 6,280,233 and 6,712,641, and Fricke et al U.S. Pat. No. 6,796,855, among others.

In the German patent No. DE 297 06 750 U1, an electrical connector is disclosed in which a plurality of taps are provided for tapping off electrical current from an insulated conductor. For this purpose, a plurality of groove-like seats are provided on a base plate into which seats one can insert a flat cable or a plurality of electrical conductors that are parallel with respect to each other. Then an upper part is displaced in order to slacken the conductors or the flat cable. Upon this preassembled unit, which is provided with separating walls, one then locks clamp-like bodies in a pivotal motion, which bodies in each case are provided with an insulation-penetrating contact that is connected via a bus bar with, in each case, two traction spring clamps for connection of branching conductors. In this manner, one can make in each case two branches on each conductor without having to separate the continuous conductors.

It is also known that one can arrange connection devices on a shaft that is rotatably mounted on a bottom plate. This design did not prove effective because the conductors must be inserted sideways so that the arrangement is not suitable for assembly on already installed continuous cables.

The present invention therefore is an improvement over the typical state of the prior art and seeks to simplify said state of the art with respect to its design structure. A compact structure and easy handling are also to be achieved as a result.

SUMMARY OF THE INVENTION

Accordingly, a primary object of the present invention is to provide a connector arrangement in which a plurality input insulated conductors are supported in parallel, spaced, alternately-staggered coplanar arrangement on a rectangular base member, whereupon pivot members pivotally connected with opposite ends of the base member are pivoted downwardly to cause insulation piercing contacts thereon to pierce the insulation layers of alternate insulated conductors, respectively. A plurality of bus bars connect the piercing contacts with the output contacts of junction boxes that are rigidly fastened to the pivot members, respectively. The output contacts are preferably of the quick-fastening one-way resilient contact type that automatically engage the bare end of an output conductor that is inserted through an access opening in the junction block.

According to a more specific object of the invention, insulation means are provided for electrically isolating the pivotally displaceable junction blocks from each other. In one embodiment, insulation plates are mounted on the adjacent sides of the junction blocks. In another embodiment, each pivot member and junction block that pivot as a unit at one end of the base member is contained within the chamber of an insulating jacket that is mounted on the base member. At the other end, a similar insulating jacket is provided having chambers for receiving the pivot units, respectively.

In terms of design, the connector arrangement is further simplified when compared to the state of the art because the invention uses tool-free connectable IDC contacts, in particular, insulation layer penetrating fork contacts for wiring purposes. In spite of the use of the IDC contacts with the greater width due to its design—especially in the version as fork contacts—it produces a very narrowly structured arrangement consisting of connecting devices, which furthermore in a simple manner makes it possible in an extremely simple fashion without the use of any tools to contact both the continuous conductors and the branching conductors (at any rate, when direct plug contacts are used).

The continuous conductors, for example, can be the continuous conductors of a flat cable or any other cable—for example, a round cable—whose cable sheath was removed in the area of the connection system, whereby the continuous conductors in this sheath-stripped area are inserted in the recesses of the bottom plate. For contacting purposes, one then merely needs to put on the connection disc, to swing them, and then to insert the conductor ends of the branch conductors. In this way, one can also quickly and subsequently assemble a branching on an already installed cable.

It is also desirable that, in any event, the IDC contacts of neighboring connection discs in the chosen staggered arrangement are located relatively far removed from each other, something that definitely reduces any disadvantageous effects such as the occurrence of undesirable leakage currents.

An advantageous development that can also be considered as an independent invention of its own is given in the second embodiment including insulating jacket means, whose object is distinguished by a particularly simple handling coupled with a furthermore particularly good insulation of the individual conductors from each other.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
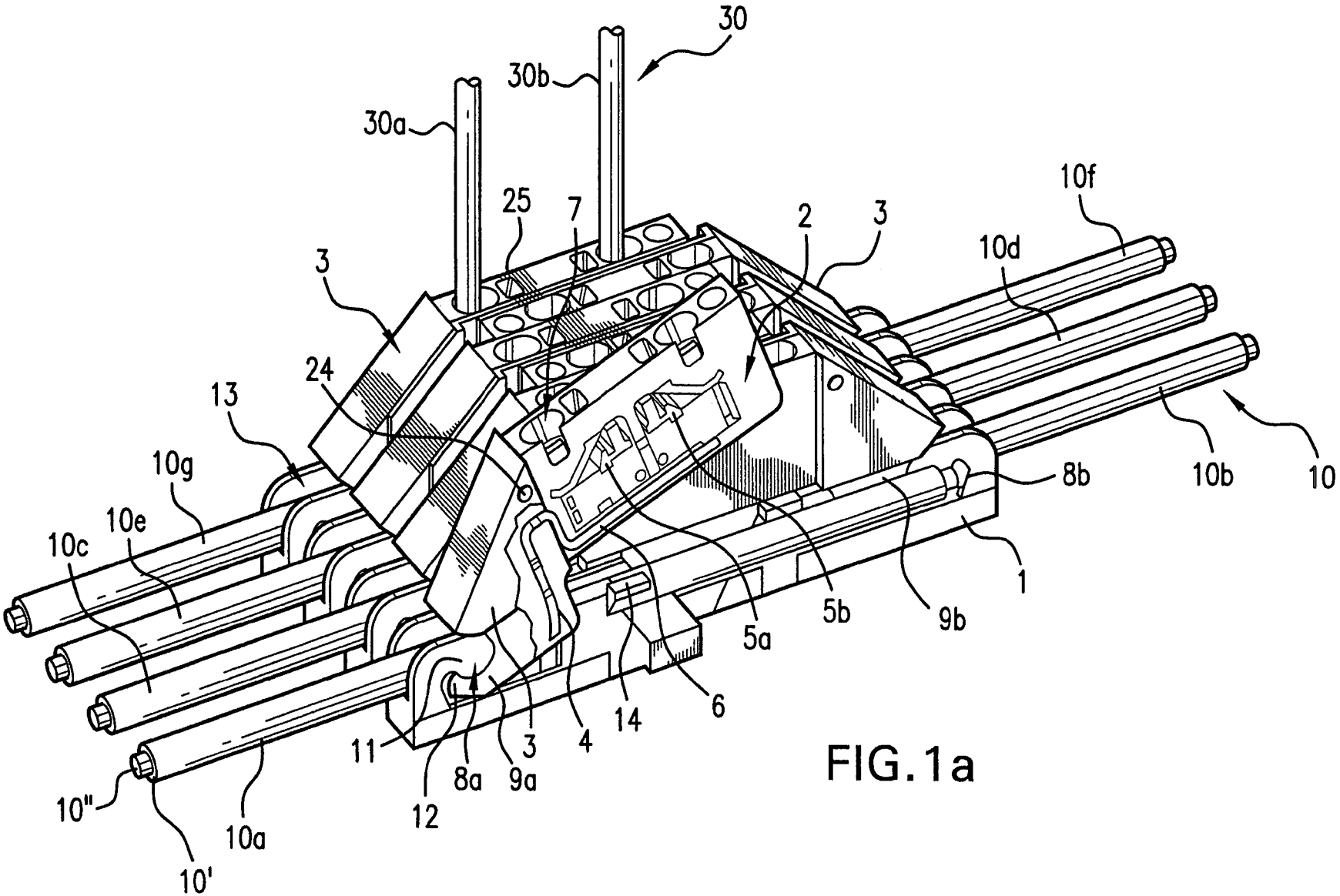
FIG. 1*a* is a front perspective view of a first embodiment of the connector arrangement of the present invention when in the partially assembled condition, and with certain parts broken away.

Referring first more particularly to FIG. 1*a*, the connector apparatus of the present invention includes a generally rectangular base member 1 having an upper surface containing a plurality of parallel longitudinally extending seats 13 for receiving a plurality of parallel alternately-staggered insulated conductors 10. Pivotally connected with the ends of the base member 1 by pivot means 8*a* and 8*b* are a plurality of pivot members 3. As will be explained in greater detail below, to each pivot member 3 is fastened by fastening means 24 to a junction block 2, thereby to define a rigid pivot unit. The pivot units defined by the assembly of the pivot member 3 and the junction block 2 are pivotally movable between a disengaged condition angularly inclined relative to the base member 1 (as shown in FIG. 1*d*), and an engaged condition in which the units are pivoted to positions parallel with the base member 1, as shown in FIG. 1*e*.

In accordance with a characterizing feature of the present invention, each pivot member 3 is provided with a bifurcated insulation piercing fork 4 that is adapted to pierce the insulation layer 10' of a given conductor, thereby to effect electrical engagement between the insulation piercing member 4 and the inner conductor member 10" of the insulated conductor 10. The insulation piercing fork 4 is connected by means of a bus bar 6 contained within the junction block 2 to a pair of outlet contacts 5*a* and 5*b* that are arranged beneath access openings 7*a* and 7*b* contained in the top wall of the junction block 2. The bare ends of output conductors 30 are adapted for insertion within the access openings 7*a* and 7*b* for engagement with the contacts 5*a* and 5*b*, respectively, thereby capping off a portion of the current from the conductor 10 for supply to the output conductors 30.

Figure 1B:
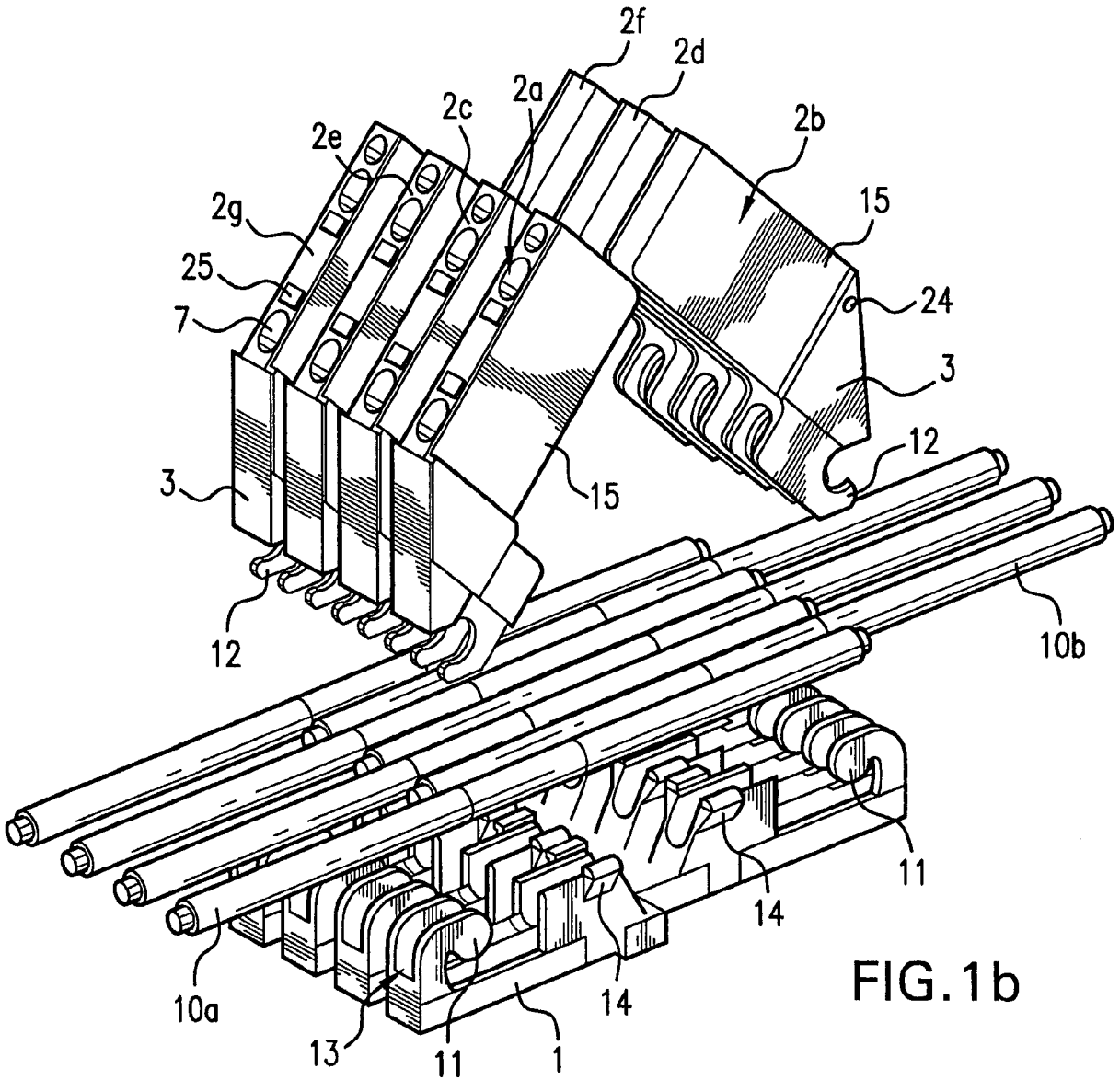
FIG. 1*b* is an exploded perspective view of the apparatus of FIG. 1*a;*

Referring to FIG. 1*b*, it will be seen that the pivot members 3 are provided at their lower corners with outwardly facing laterally spaced hook portions 12 that are arranged for engagement with corresponding inwardly directed hook portions 11 integral with the base member 1. As shown in FIG. 1*b*, the insulated conductors 10 are staggered in such a manner that the cable ends of alternate cables 10*a*, 10*c*, 10*e*, and 10*g* extend in one direction relative to the base member 1, and the ends of the alternate insulated cables 10*b*, 10*d*, and 10*f* extend in the opposite direction relative to the base member 1. Similarly, the associated pivot units defined by the pivot members 3 and the junction blocks 2 fastened thereto are spaced in a comb-like fashion, whereby the junction blocks 2*a*, 2*c*, 2*e*, and 2*g* are spaced to receive the junction blocks 2*b*, 2*d*, and 2*f*. Thus, after the insulated conductors 10 are inserted within their respective conductor seats 13 as shown in FIG. 1*c*, the hook portions 12 of the pivot members 3 are connected with the corresponding hook portions 11 on the base plate 1, as shown in FIG. 1*d*, where upon the pivot units are pivoted downwardly toward the fully engaged positions of FIG. 1*e*.

Figure 2:
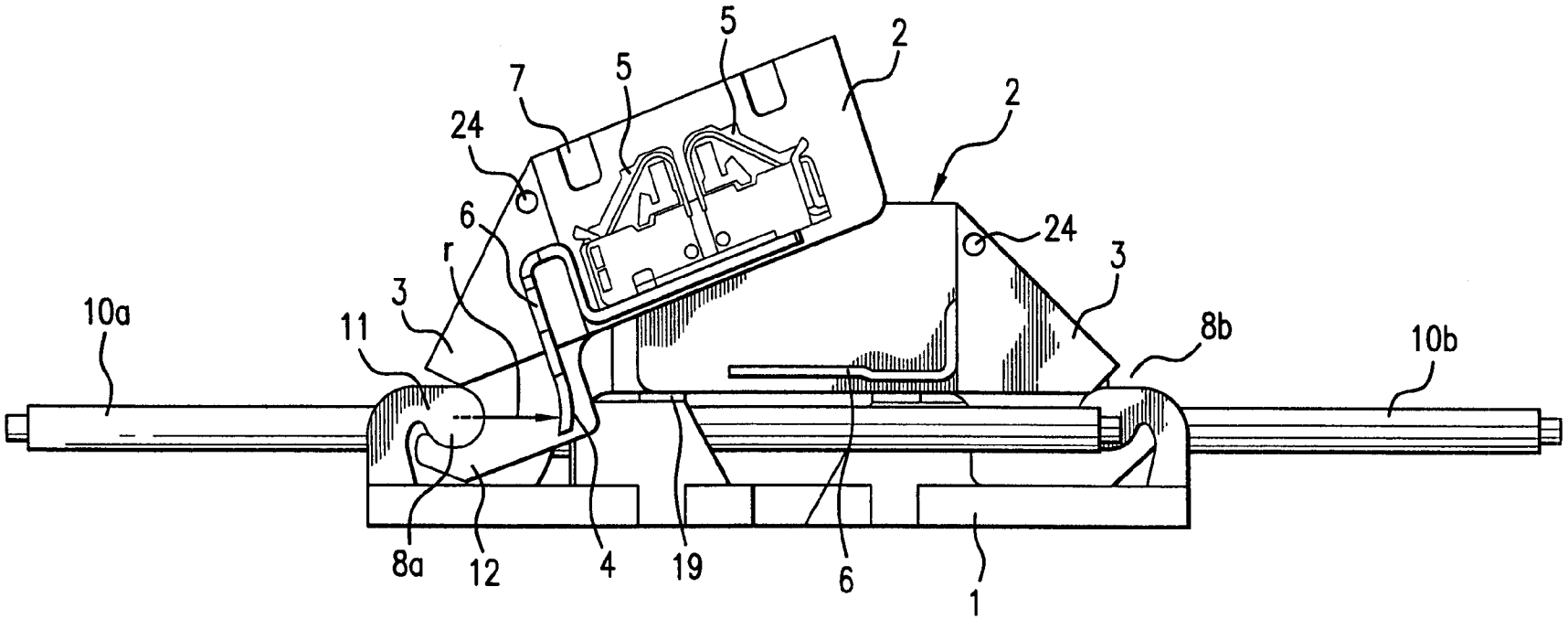
FIG. 2 is a side elevation view of the apparatus of FIG. 1*a* with certain parts removed.
Figure 3:
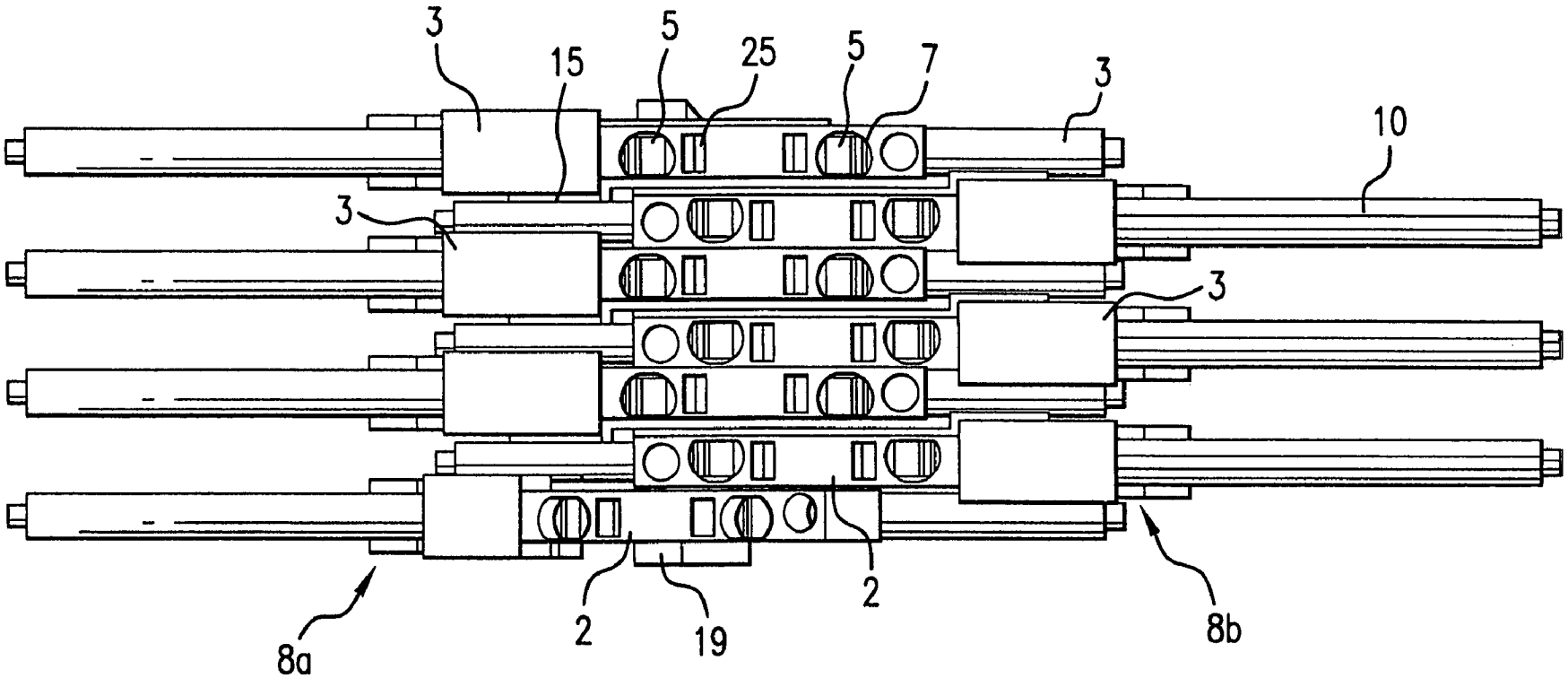
FIG. 3 is a top plan view of the apparatus of FIG. 2.

Referring now to FIG. 2, when the pivot unit comprising the pivot member 3 and the junction block 2 is pivoted downwardly about the hinge means 8*a*, the knife edges of the bifurcated fork 4 will sever the insulation layer 10' of the insulated conductor 10*a*. As the pivot unit is progressively pivoted downwardly toward the fully engaged position, the knife edges of the bifurcated fork 4 come into electrical contact with the inner conductor of the insulated cable 10*a*. Current is transmitted to the two branch contacts 5 via the bus bar 6. As shown in FIG. 2, a mechanical advantage is provided by the pivot radius r, which is the distance between the pivot means 8*a* and the knife edges of the bifurcated fork 4. As shown in FIGS. 1*b* and 3, the sides of the junction blocks are covered by cover plates 15 that are formed from an electrically insulating synthetic plastic material, thereby to isolate the contacts of one junction block from the output contacts of the other junction blocks.

Figure 1C:
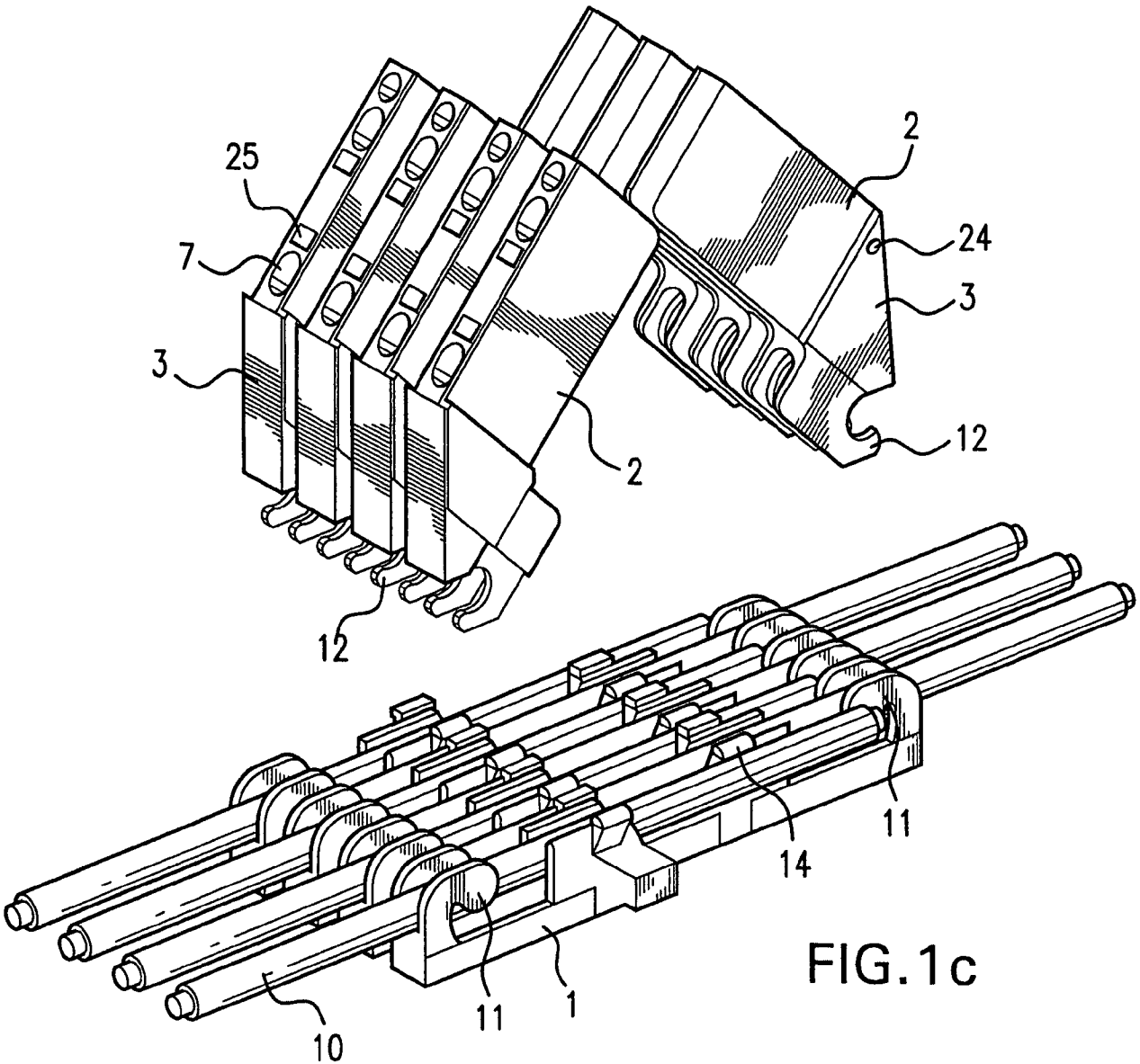
FIG. 1*c* is a perspective view of the apparatus of FIG. 1*b* with the conductors inserted in the base member.
Figure 1D:
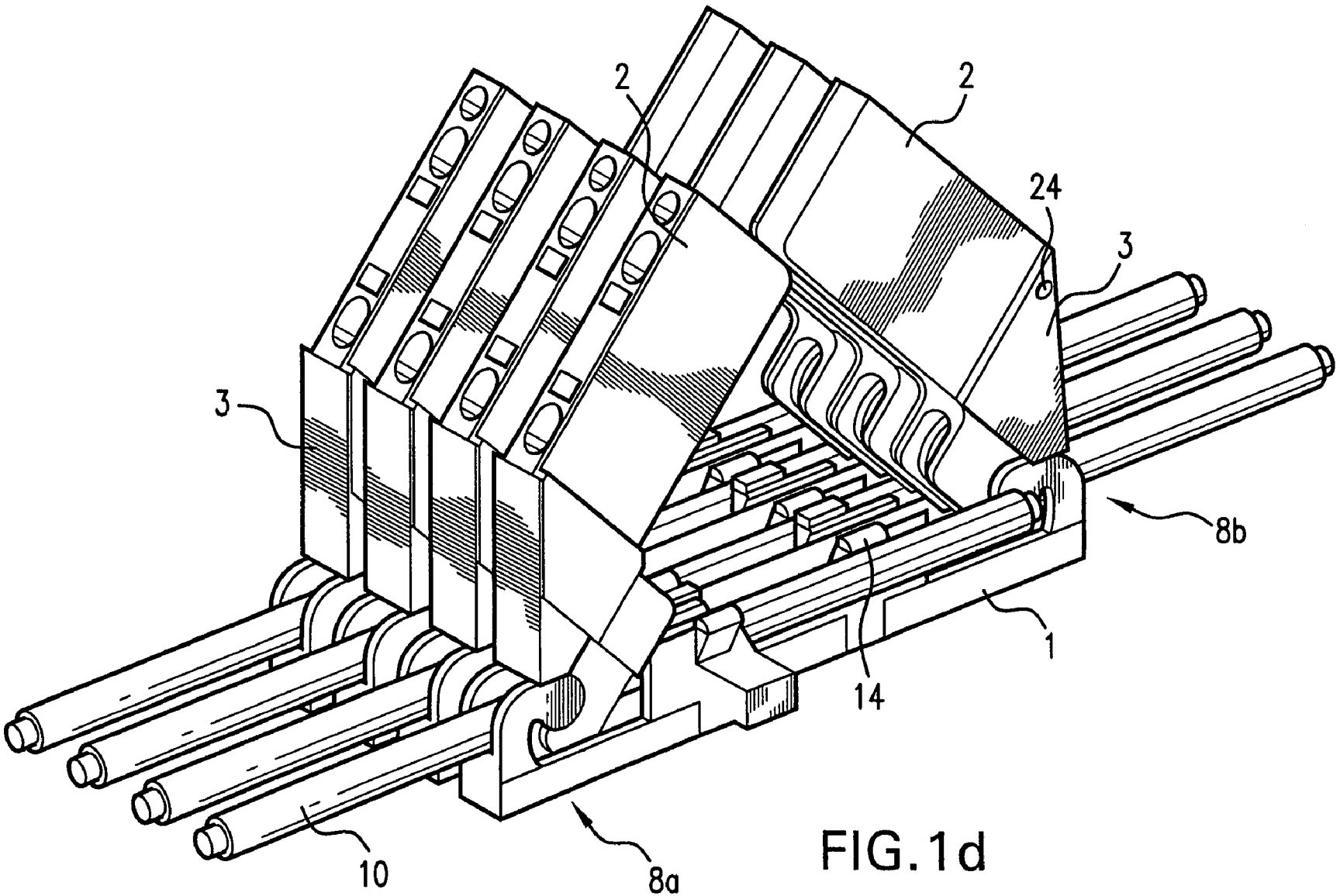
FIG. 1*d* is a perspective view of the apparatus of FIG. 1*c* with the pivot means in the connected condition.
Figure 1E:
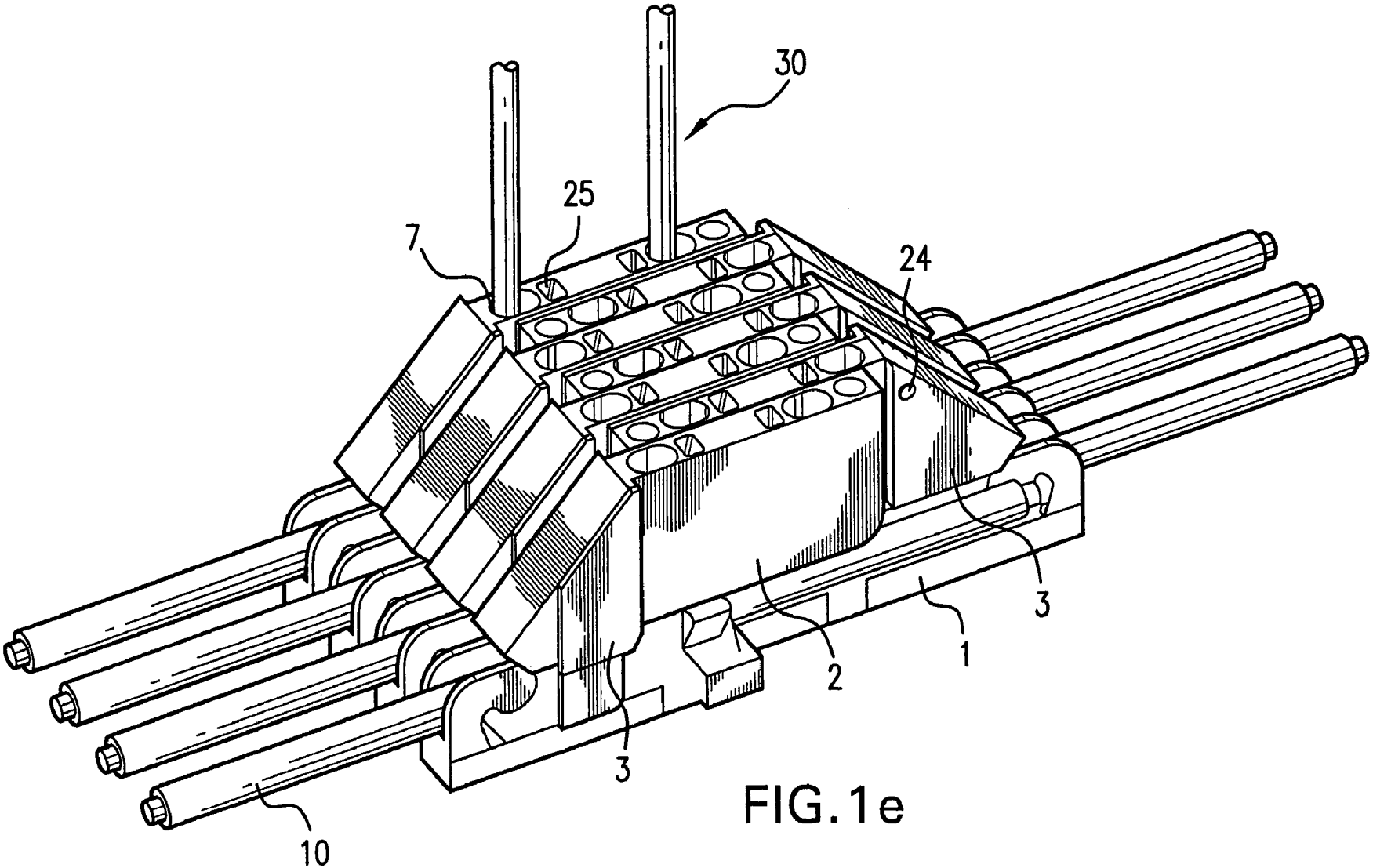
FIG. 1*e* is a perspective view of the apparatus of FIG. 1*d* with the pivot members and the junction blocks in the fully assembled condition.

Referring to FIGS. 1*c* and 1*d*, the base member 1 is provided with friction catches 14 that engage the sides of the junction blocks 2, thereby to retain the same in the engaged position shown in FIG. 1*e*. Support bridges 19 may be provided for supporting the junction blocks relative to the base plate 1.

In the illustrated first embodiment of FIGS. 1*a*-3, the resilient contacts 5 of the junction blocks are of the one-way leaf spring type arranged for locking engagement with the bare end of the output conductors 30, as is known in the art. Thus, as the output conductor is axially inserted into the access opening 7, the base conductor bends the resilient leaf spring contact 5 downwardly until the edge of the leaf spring engages the outer circumferential surface of the bear output conductor 30. To release the output conductor, a suitable tool, such as the tip of a screwdriver, is inserted within the release opening 32, as is known in the art. Of course, other types of contacts, such as screw contacts, or the like, could be provided for connection with the output conductors 30.

Referring again to FIG. 3, it will be seen that the width of the pivot bodies 3 is wider than the width of the junction blocks 2, whereby owing to the interspersion of the narrow junction blocks 2, a compact relatively narrow connector arrangement is provided.

Figure 4A:
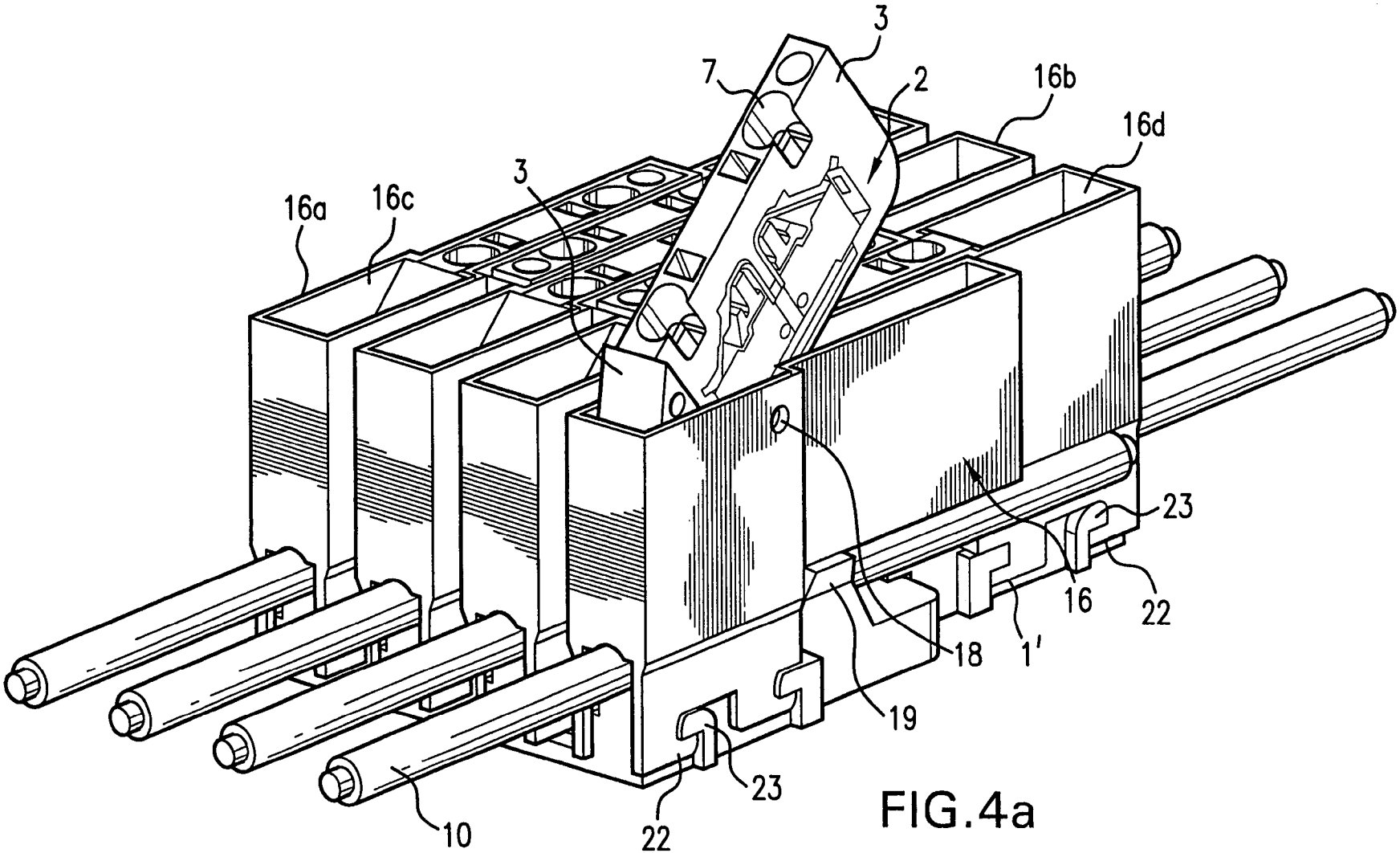
FIG. 4*a* is a front perspective view of a second embodiment of the invention when in a partially assembled condition.
Figure 4B:
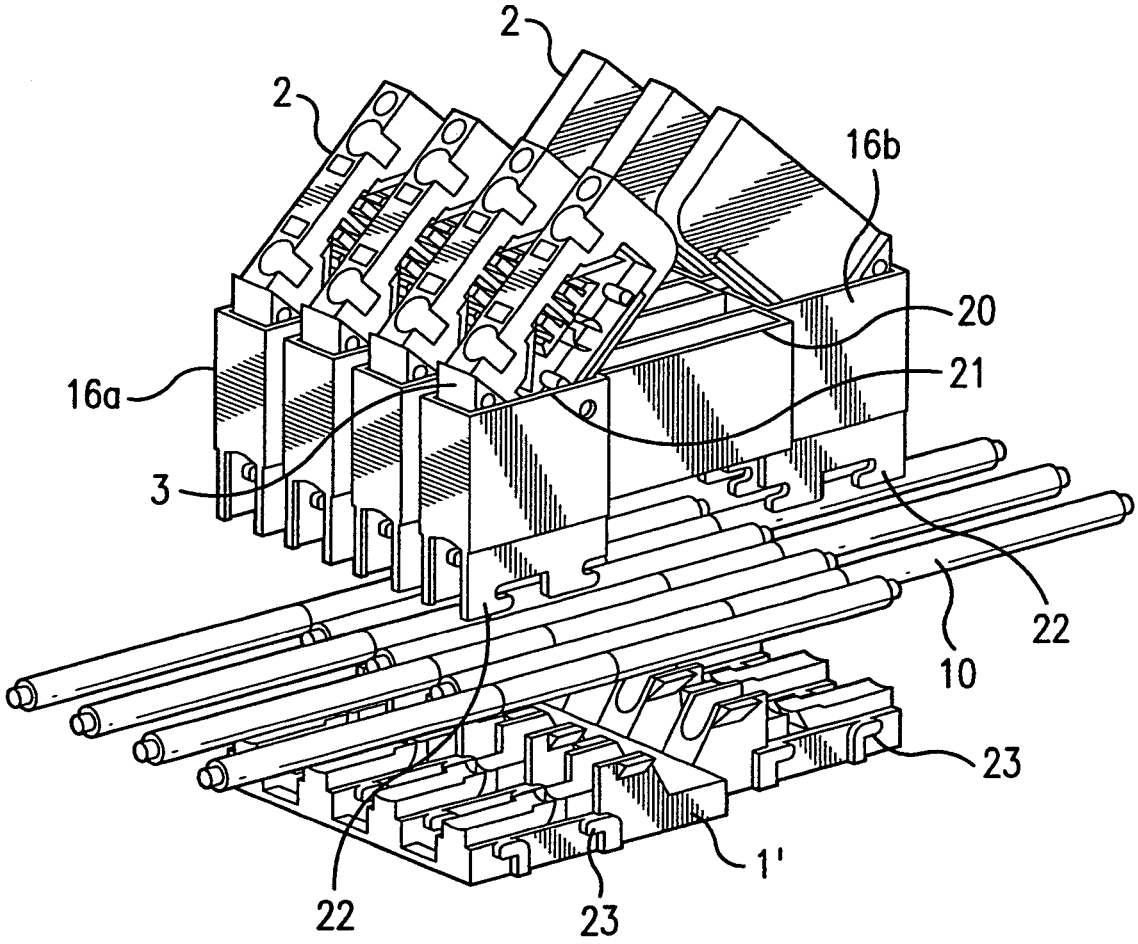
FIG. 4*b* is an exploded perspective view of the apparatus of FIG. 4*a;*
Figure 4C:
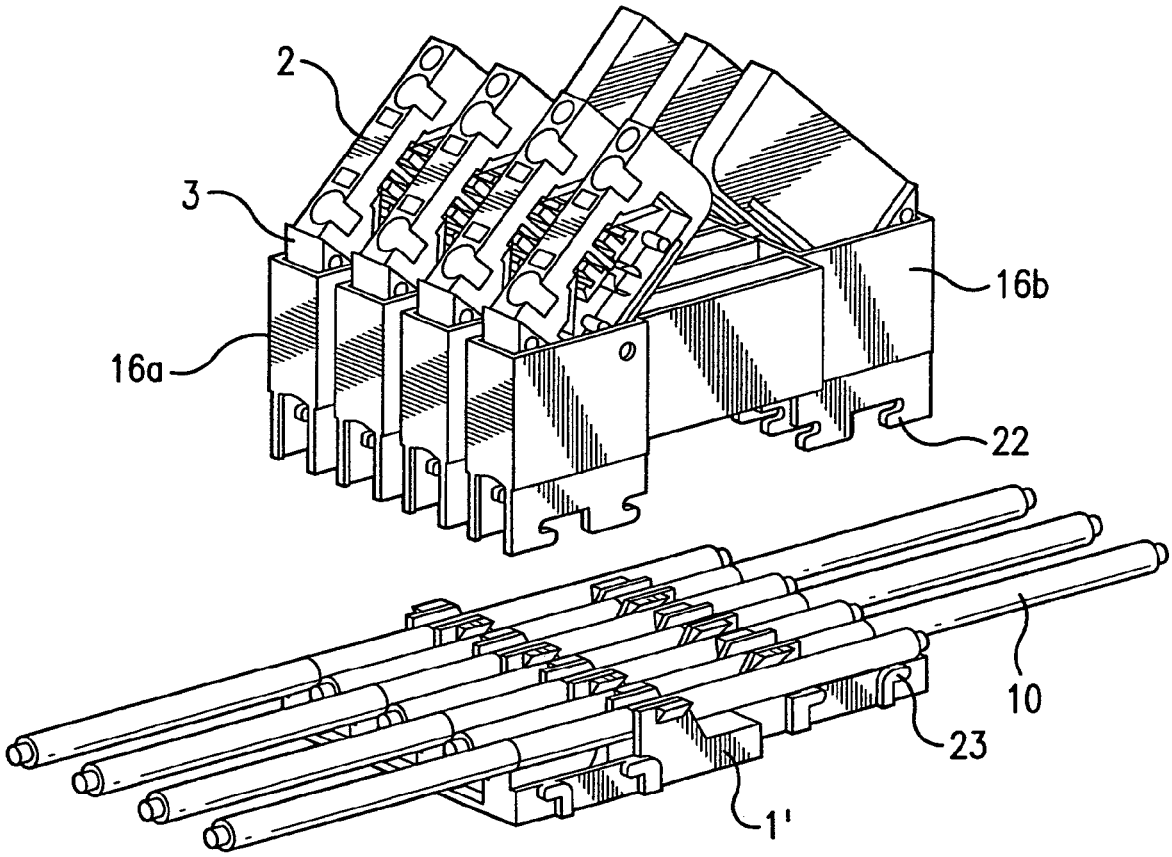
FIG. 4*c* is a perspective view of the apparatus of FIG. 4*b* with the conductors inserted in the corresponding seats contained in the base member.
Figure 4D:
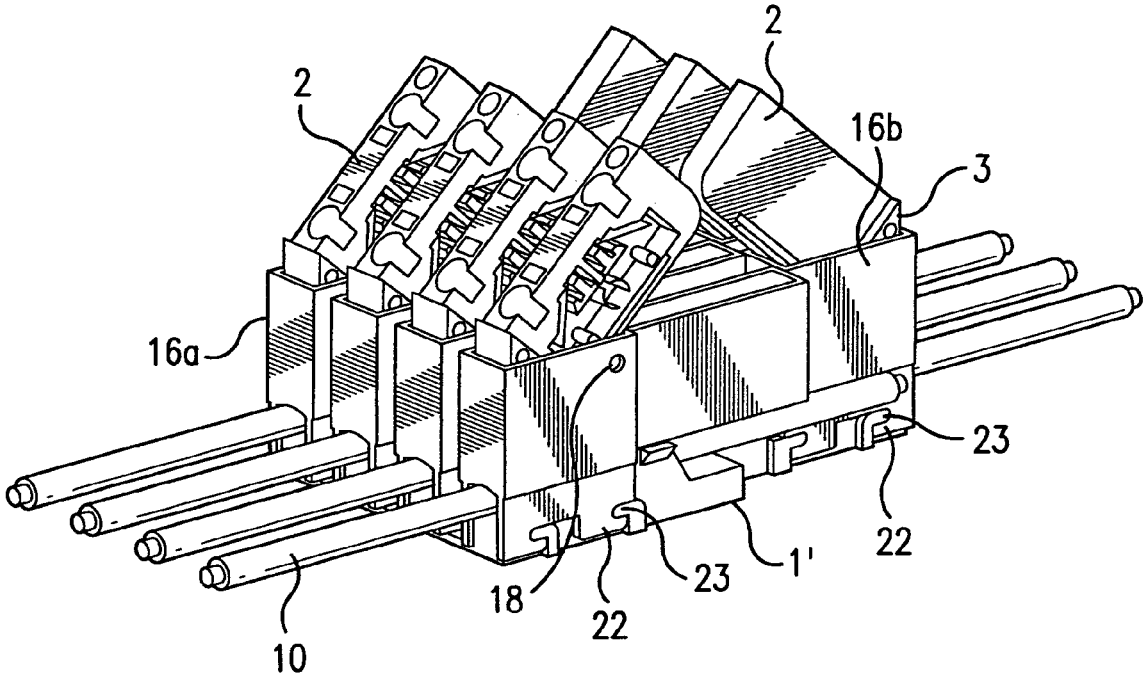
FIG. 4*d* is a perspective view of the apparatus of FIG. 4*c* with the insulating jackets connected with the base member.
Figure 4E:
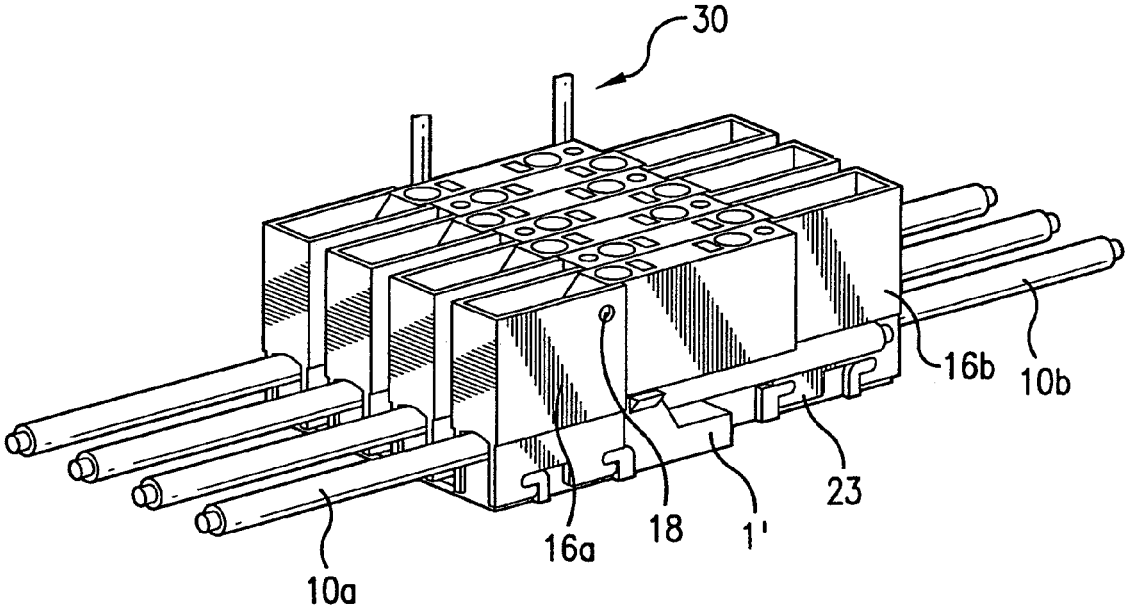
FIG. 4*e* is a perspective view of the apparatus of FIG. 4*d* when in the fully assembled condition.
Figure 5:
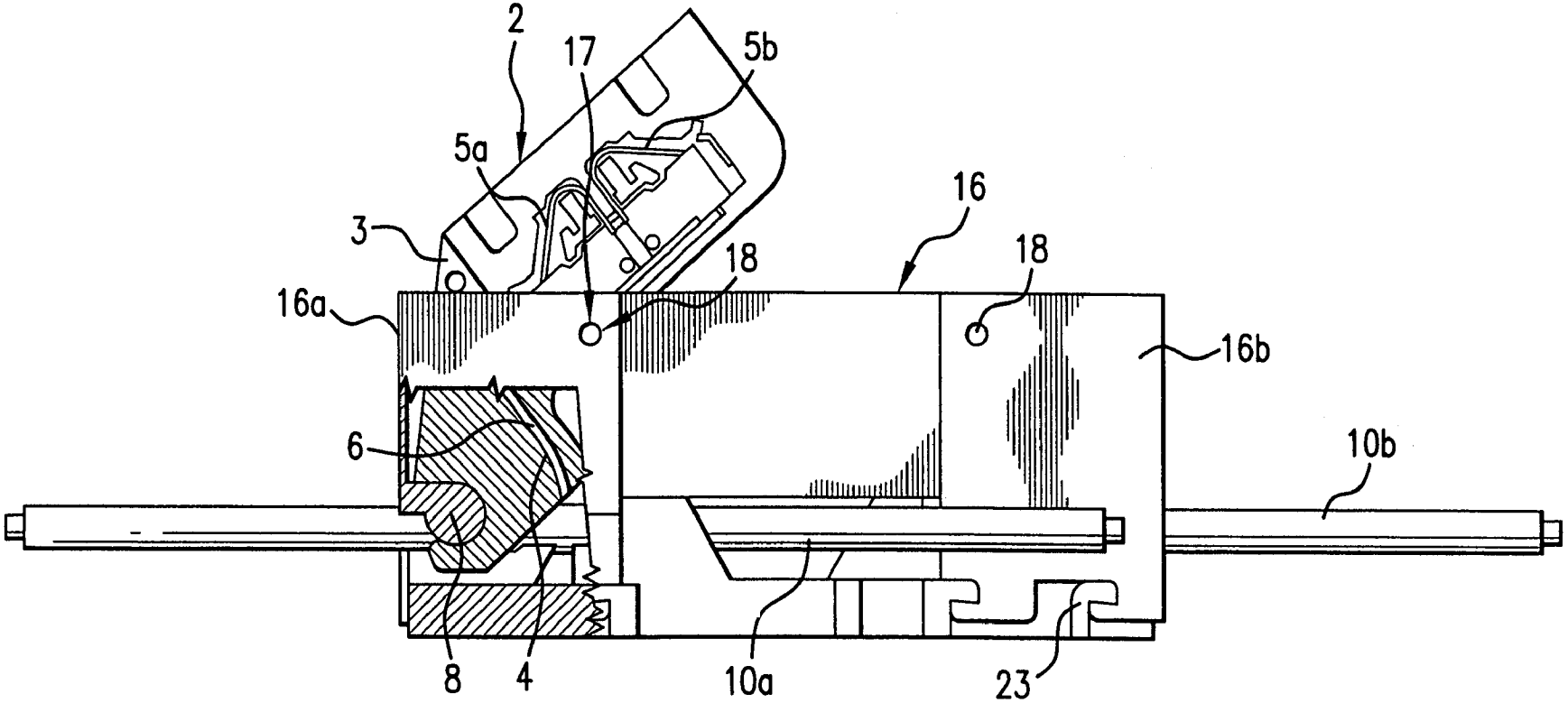
FIG. 5 is a partially sectioned side elevation view of the apparatus of FIG. 4*a*.

Referring now to the second embodiment of the invention illustrated in FIGS. 4*a*-4*e*, in order to provide positive isolation between the respective junction blocks 2, a pair of insulating jackets 16*a* and 16*b* are provided that are respectively connected with opposite ends of the base member 1'. The jacket 16*a* is provided with a plurality of open ended chambers 16*c* that receive the pivot units at the left-hand end of the base member, and the right-hand jacket 16*b* contains a plurality of open-ended chambers 16*d* that receive the pivot units that are connected with the right-hand end of the support member 1'. The protective jackets 16 are formed of a suitable electrically insulating synthetic plastic material for isolating the junction blocks 2 from each other. As shown in FIG. 4*b*, when the insulated conductors 10*a*-10*g* are inserted within their respective conductor seats 13, the positions shown in FIG. 4, the assembly of the pivot units carried by the jacket 16*a* are lowered to the position shown in FIG. 4*d*, whereupon the jacket 16*a* is displaced to the right, thereby to cause the hook members 22 on the jacket 16*a* to come into engagement with the corresponding hook members 23 integral with the base member 1', thereby to securely fasten the elements together as shown in FIG. 4*d*. Similarly, the right-hand protective jacket 16*b* is lowered relative to the base member 1', whereupon the jacket 16*b* is shifted to the left to effective engagement between the inwardly facing hook means 22 thereon and the outwardly facing hook means 23 integral with the base member 1'. The insulating jackets 16*a* and 16*b* are thus rigidly fastened to the base member 1' as shown in FIG. 1*d*. In this embodiment, releasable catch means 17 and 18 are provided for retaining the pivot units in the upwardly pivoted disengaged condition, as shown in FIG. 5. The catch means includes a male member 17 that is biased outwardly toward engagement with a corresponding aperture 18 contained in a side wall of the jacket 16*a*.

Referring now to FIG. 5, it will be seen that the pivot unit consisting of the pivot member 3 and the junction block 2 function in the same manner as in the previous embodiment, since the bifurcated fork 4 is arranged to sever the layer of insulation on the conductor 10*a*, thereby to connect the conductor 10" with the output contacts 5 via the insulation piercing fork 4 and the bus bar 6. Thus, the operation of the connector arrangement of FIG. 5 is identical to that of the arrangement of FIG. 2.

Figure 6:
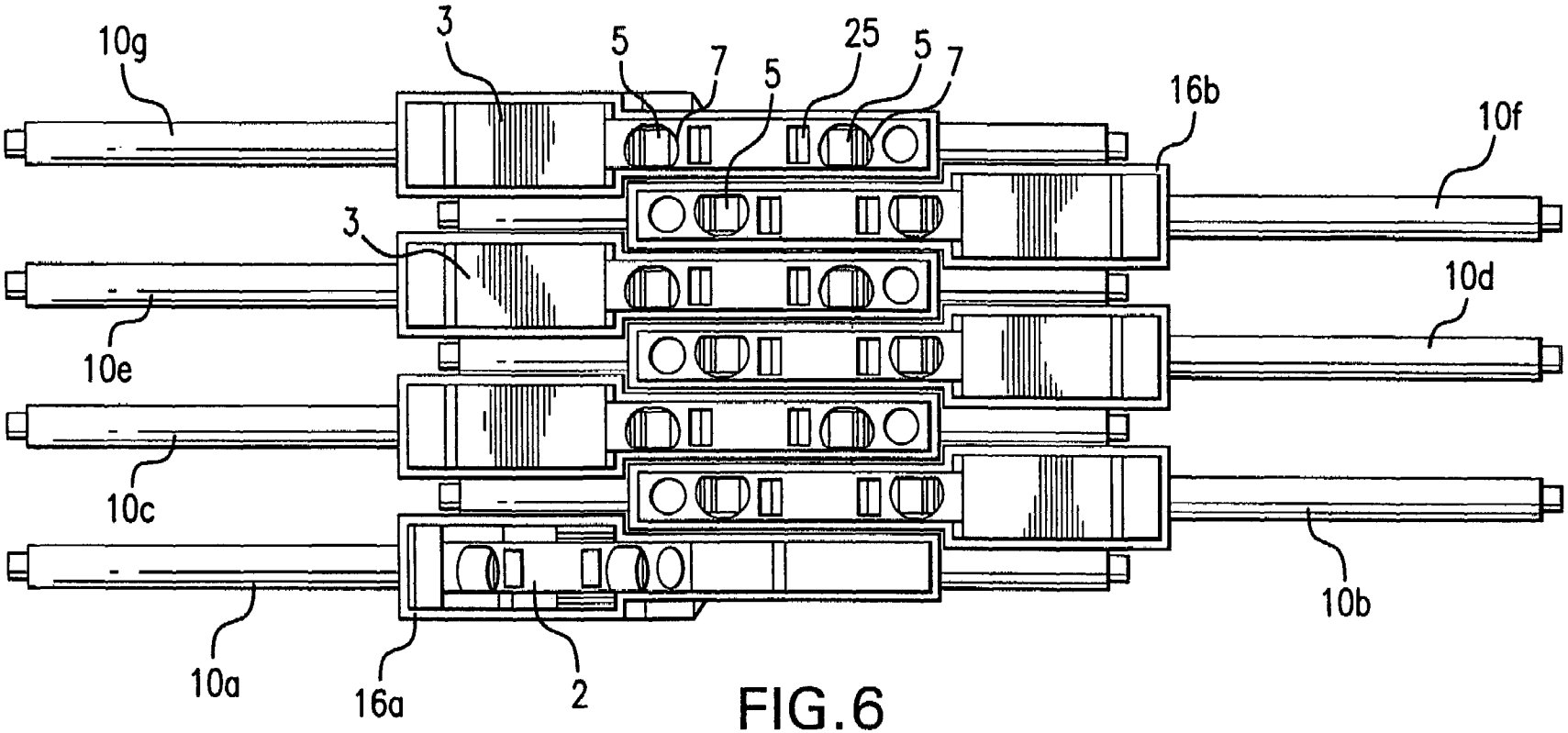
FIG. 6 is a top plan view of the apparatus of FIG. 5.

Referring to FIG. 6, it will be seen that the chambers contained in the jackets 16*a* and 16*b* are generally T-shaped, with the transverse portions that receive the pivot members 3 being wider than the longitudinal portions that receive the junction blocks 2.

It should also be mentioned that the entire arrangement in FIGS. 1 to 6 can again be set up within a master cover housing. It is also conceivable that one might use them directly for assembly, for example, in the switch cabinet, assuming the bottom plates are corresponding designed with a corresponding fastening. Furthermore, one can make cross-connections and/or markings or the like, for instance, on the connection discs. It is also possible to replace the direct plug connections with other connections using the other connection technique—for example, IDC technique, traction spring technique or screw connection technique—and/or to provide the connection discs with electrical structural elements (again not shown here).

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector arrangement for supplying tapped-off current from a plurality of parallel spaced coplanar insulated input conductors (10) to a plurality of output conductors (30), comprising:

(a) a rectangular base member (1) having a horizontal upper surface containing a plurality of coplanar parallel longitudinally extending conductor seats (13) adapted to receive the input insulated conductors, respectively;

(b) a plurality of pivot members (3) arranged above said conductor seats, respectively; (c) a plurality of pivot means (8) pivotally connecting successive ones of said pivot members with opposite ends of said base member for pivotal movement about transverse horizontal pivot axes between engaged and disengaged positions relative to said base member, respectively, each of said pivot members including piercing contact means (4) for piercing the insulation layer and electrically engaging the conductor of the insulated conductor arranged in the associated conductor seat, respectively; and (d) a plurality of output terminal means (5) respectively connected with said piercing contact means for connecting said input conductors with corresponding output conductors (30), respectively.

2. An electrical connector arrangement as defined in claim 1, wherein said output terminal means comprises:

(a) a plurality of junction blocks (2) extending above and parallel with said input conductor seats, respectively, each of said junction blocks including at least one output terminal (5) adapted for connection with the bare end of an associated one of said output conductors that is inserted into said junction block via an associated access opening (7);

(b) fastening means (24) rigidly fastening each junction block at one end with the associated pivot member, whereby each of said pivot members and the associated junction block pivot as a pivot unit; and (c) bus bar means (6) connecting said piercing contacts with the output terminals of the associated junction blocks, respectively.

3. A connector arrangement as defined in claim 2, and friction means (14) mounted on said base member for laterally engaging and supporting the sides of said junction blocks when said pivot members are in their engaged positions.

4. A connector arrangement as defined in claim 3, and further including bridge means (19) arranged on said base member for supporting the bottom walls of said junction blocks when said pivot members are in their engaged positions.

5. A connector arrangement as defined in claim 4, and further including insulation means (15; 16) arranged between the output terminals successive junction blocks.

6. A connector arrangement as defined in claim 5, wherein said insulation means comprises a side wall layer (15) formed of an electrically insulating synthetic plastic material mounted on each of the adjacent side walls of said junction blocks.

7. A connector arrangement as defined in claim 5, wherein said insulation means comprises protective jacket means (16) formed of electrically insulating synthetic plastic material mounted on the upper surface of said base member, said jacket means including a plurality of open-ended chambers (16*a*, 16*b*) receiving said junction block and pivot member units, respectively.

8. A connector arrangement as defined in claim 7, wherein said protective jacket means comprises a pair of insulating jackets (16*a*, 16*b*) arranged at opposite ends of said base member, respectively, and fastening means (22, 23) fastening said jackets with said base member, respectively, the chambers of one of said jackets respectively receiving the pivot member and junction block units at one end of said support member, and the chambers of the other of said jackets respectively receiving the pivot member and junction block units at the other end of said base member.

9. A connector arrangement as defined in claim 8, wherein each of said chambers has a generally T-shaped horizontal cross-sectional configuration, the transverse portion (21) of the T being relatively enlarged for receiving the pivot member of the associated pivot unit, the longitudinal portion (20) of the T being relative narrow for receiving the junction block of the associated pivot unit, the longitudinal portions of one jacket extending in comb-like fashion in parallel interspersed relation between the corresponding longitudinal portions of the other jacket.

10. A connector arrangement as defined in claim 9, wherein said insulating jackets are relatively longitudinally slidably displaceable between adjacent and separated positions; and further wherein said fastener means (22, 23) fasten said jackets to said base member when said jackets are displaced toward said adjacent position.

11. A connector arrangement as defined in claim 7, and further including releasable catch means (17, 18) arranged between said junction blocks and said insulating jackets for retaining said junction blocks in their disengaged positions relative to said base member.

12. A connector arrangement as defined in claim 2, wherein each of said insulation piercing means comprises a bifurcated fork member having opposed spaced knife edges for cutting the insulation layer on opposite sides of a conductor arranged therebetween.

13. A connector arrangement as defined in claim 12, wherein each of said pivot members includes a first corner portion (9*a*, 9*b*) that is pivotally connected with said base member, and further wherein said bifurcated fork member is arranged on a second corner potion of said pivot member remote from said first corner portion, thereby to afford a mechanical advantage having a cutting radius "r" for cutting the insulation layer.

14. A connector arrangement as defined in claim 13, wherein each of said pivot means comprises a pair of laterally spaced inwardly directed first hook portions (11) mounted on said base member on opposite sides of said pivot member, and a cooperating pair of outwardly directed second hook portions (12) carried by first corner portions (9*a*, 9*b*) of said pivot members.

15. A connector arrangement as defined in claim 14, wherein each of said pivot members has a generally U-shaped cross-sectional configuration defining a pair of spaced side walls carrying said second hook portions, respectively, the adjacent end portions of the associated junction block extending into and being fastened within the space defined between said pivot member side walls.

16. A connector arrangement as defined in claim 2, wherein each of said output terminals (5) is of the one-way leaf-spring bare conductor gripping type, each of said junction blocks including a release access opening (32) adjacent said outlet conductor access opening for receiving a contact-releasing tool.

17. A connector arrangement as defined in claim 16, wherein each of said junction blocks contains a pair of said outlet contacts (5*a*, 5*b*) connected with said insulation piercing contact via said bus bar, said junction block containing a pair of access openings opposite said outlet contacts, respectively.

* * * * *